US006938830B2

(12) United States Patent
Bucceri

(10) Patent No.: US 6,938,830 B2
(45) Date of Patent: Sep. 6, 2005

(54) SNOW MAKING METHOD AND APPARATUS

(75) Inventor: Alfio Bucceri, Queensland (AU)

(73) Assignee: Snow Factories PTY LTD, Brisbane (AU)

( * ) Notice: Subject to any disclaimer, the term of this patent is extended or adjusted under 35 U.S.C. 154(b) by 0 days.

(21) Appl. No.: 10/475,228

(22) PCT Filed: Apr. 19, 2002

(86) PCT No.: PCT/AU02/00492

§ 371 (c)(1),
(2), (4) Date: Mar. 15, 2004

(87) PCT Pub. No.: WO02/086401

PCT Pub. Date: Oct. 31, 2002

(65) Prior Publication Data

US 2004/0144852 A1 Jul. 29, 2004

(30) Foreign Application Priority Data

Apr. 19, 2001 (AU) ..... PR4405
May 2, 2001 (AU) ..... PR4697
Nov. 15, 2001 (AU) ..... PR8883

(51) Int. Cl.[7] ..... F25C 3/04

(52) U.S. Cl. ..... 239/2.2; 239/14.2

(58) Field of Search ..... 239/2.2, 14.2, 239/2.1; 62/601, 533

(56) References Cited

U.S. PATENT DOCUMENTS 3,567,117 A * 3/1971 Eustis ..... 239/2.2
3,733,029 A * 5/1973 Eustis et al. ..... 239/2.2
4,793,142 A * 12/1988 Bucceri ..... 62/74
5,289,973 A * 3/1994 French ..... 239/14.2
5,660,935 A 8/1997 Kambayashi et al. ..... 428/405
5,753,370 A 5/1998 Kambayashi et al. ..... 428/405
5,785,581 A * 7/1998 Settles ..... 451/99

* cited by examiner

*Primary Examiner*—David A. Scherbel
*Assistant Examiner*—Darren Gorman
(74) *Attorney, Agent, or Firm*—Baker Botts LLP

(57) ABSTRACT

A snow making method where water and/or ice is mixed with a cryogenic material, such as carbon dioxide, in a mixing vessel and the mixture is mechanically agitated or mixed to convert the water and/or ice into snow. The cryogenic material may be recovered and return for return to the vessel.

22 Claims, 8 Drawing Sheets

SNOW MAKING METHOD AND APPARATUS

BACKGROUND OF THE INVENTION

1. Field of the Invention

This invention relates to a snow making method and apparatus.

The term "snow" shall be used throughout the specification to include instant snow, powdered snow, ice crystals and the like.

The snow may be used for novelty purposes, to create snow for ski centres and ski areas (both indoors and outdoors), for use as an ice or crushed ice substitute, eg., for food and/or beverages, and the like.

2. Prior Art

Over the years, a number of methods of making snow have been proposed, and two examples will now be discussed.

The "Polar Process" is a cryogenic form of snow making, is where liquid nitrogen ($N_2$) is mixed with water atomised by an air compressor in a snow pipe to make snow. This has proven a popular form of snow production for events and promotions. While the capital cost is not great, the operational costs for making the snow are very high, as up to 500 kg of liquid nitrogen is required to be mixed with water to form one cubic meter of snow.

Another known method is the "Crushed Ice Process". This process of snow production is expensive and very labour intensive and the snow product is more in the form of shaved ice, and not a true snow crystal. The process relies on the production of, eg., 150 kg, blocks of ice which are transported to a site, and where they are put through an ice grinding machine to be shaved into saved ice particles for use as snow. The process is expensive as the blocks are expensive to buy, and require specialised transport and labour to transport and handle the blocks. The machinery to make the ice blocks is large and cumbersome, and there are very few ice-making works capable of producing the blocks. The use of this form of snow production for events has been limited.

SUMMARY OF THE PRESENT INVENTION

It is an object of the present invention to provide a snow making method which can be effected in both batch and continuous forms.

It is a preferred object to provide a method where water and/or ice can be converted into snow by mixing with a cryogenic material.

It is a still farther preferred object to provide such a method where the quantity of cryogenic material required is much lower than for existing methods.

It is a still fryer preferred object to provide a method where a large proportion of the cryogenic material can be recovered and/or recycled for further use.

It is a still further preferred object to provide a method where up to one cubic meter or more of snow can be created in less than 10 seconds.

It is a still further preferred object to provide, an apparatus for effecting the method.

Other preferred objects will become apparent from the following description.

In one aspect, the present invention resides in a method of making snow including:

mixing water in the form of a free liquid and solid cryogenic material in a mixing vessel by mechanically agitating or mixing at a speed sufficient to convert the water into snow or snow-like crystals wherein the water in the form of a free liquid is the major ingredient added to the mixing vessel.

Preferably, the solid cryogenic material is dry ice ($CO_2$).

Preferably, an additive, such as salt, sugar or other soluble material, is included in the mixture, preferably in the range of 0.25% to 1.0% (w/w).

Preferably, the $CO_2$ gas released from the mixture is drawn off from the mixing vessel and refrigerated to form liquid $CO_2$ or solid $CO_2$ for the reintroduction to the mixing vessel for addition to the mixture.

In a second aspect, the present invention resides in a method of making snow including:

mixing water in the form of a free liquid and/or ice and a cryogenic material in a mixing vessel by mechanically agitating or mixing at a speed sufficient to convert the water and/or ice into snow or snow-like crystals, wherein the ice and/or water in the form of a free liquid is the major ingredient added to the mixing vessel.

Preferably, the cryogenic material constitutes 2% to 10% (w/w), more preferably 5% to 7% of the mixture.

Preferably, the cryogenic material includes carbon dioxide ($CO_2$), nitrogen ($N_2$), oxygen ($O_2$), a frozen brine solution, or other suitable cryogenic material in solid, liquid and/or gaseous form.

Preferably the cryogenic material is placed in the mixing vessel, before the introduction of the water and/or ice, to assist in cooling the walls of the vessel.

Preferably, the mixture is agitated or mixed by at least two sets of rotating blades or knives, which are preferably mounted on the shaft, rotatably journalled in the vessel. Preferably, the first set of blades or knives urge the mixture in a direction opposed by the second set of blades or knives.

The resultant snow may be tipped from the vessel into a suitable receptacle; may be discharged from the vessel by gravity via a valve; be drawn from the vessel by vacuum or suction means; or be discharged through an outlet in a side wall of the vessel by centrifugal force; or by other suitable discharge means.

In a third aspect, the present invention resides in a snow making machine suitable for effecting the methods of the first and second aspects.

BRIEF DESCRIPTION OF THE DRAWINGS

To enable the invention to be fully understood, preferred embodiments will now be described with reference to the accompanying drawings, in which.

DETAILED DESCRIPTION OF THE PREFERRED EMBODIMENTS

Figure 1:
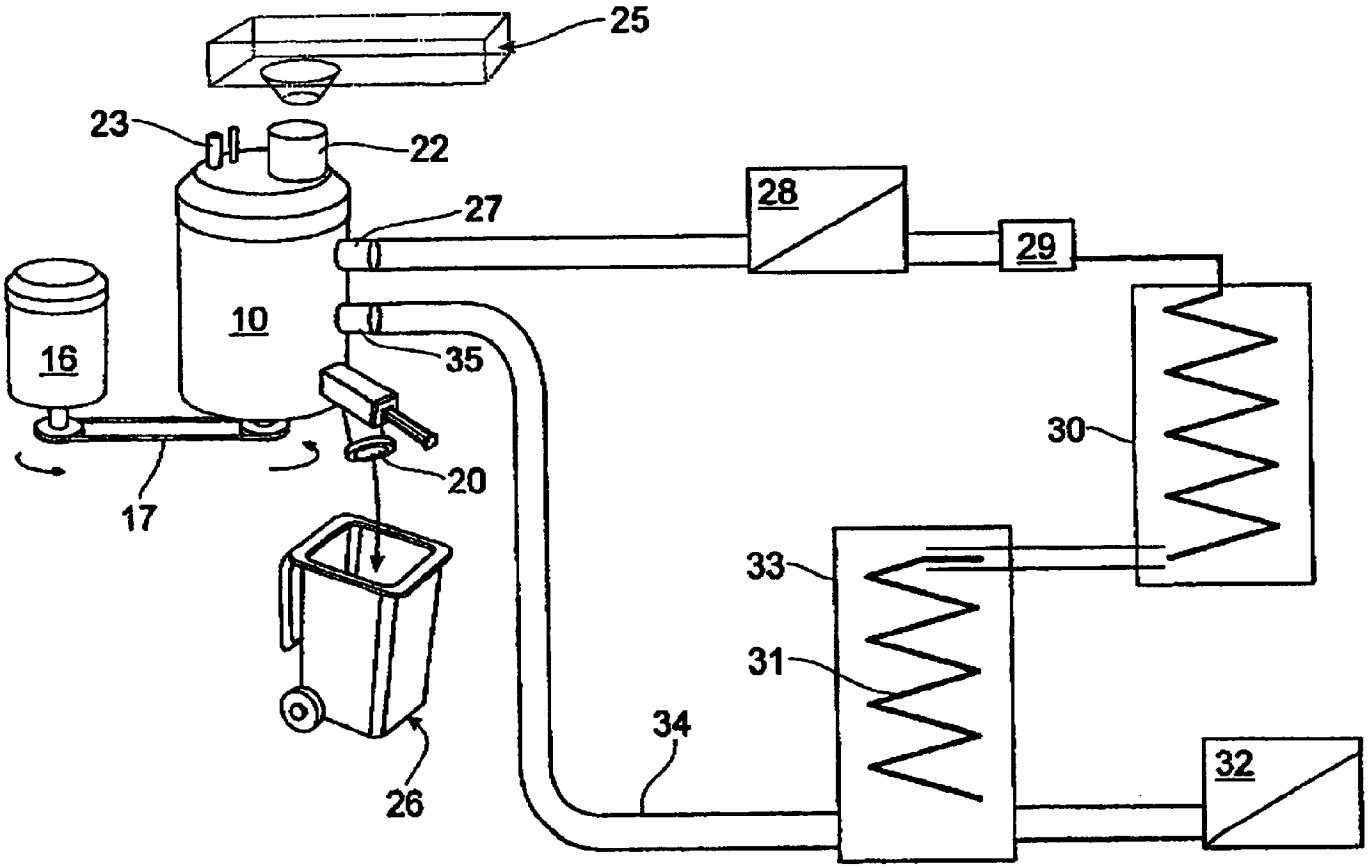
FIG. 1 is a schematic view of the machine for a first embodiment of the snow making method.
Figure 2:
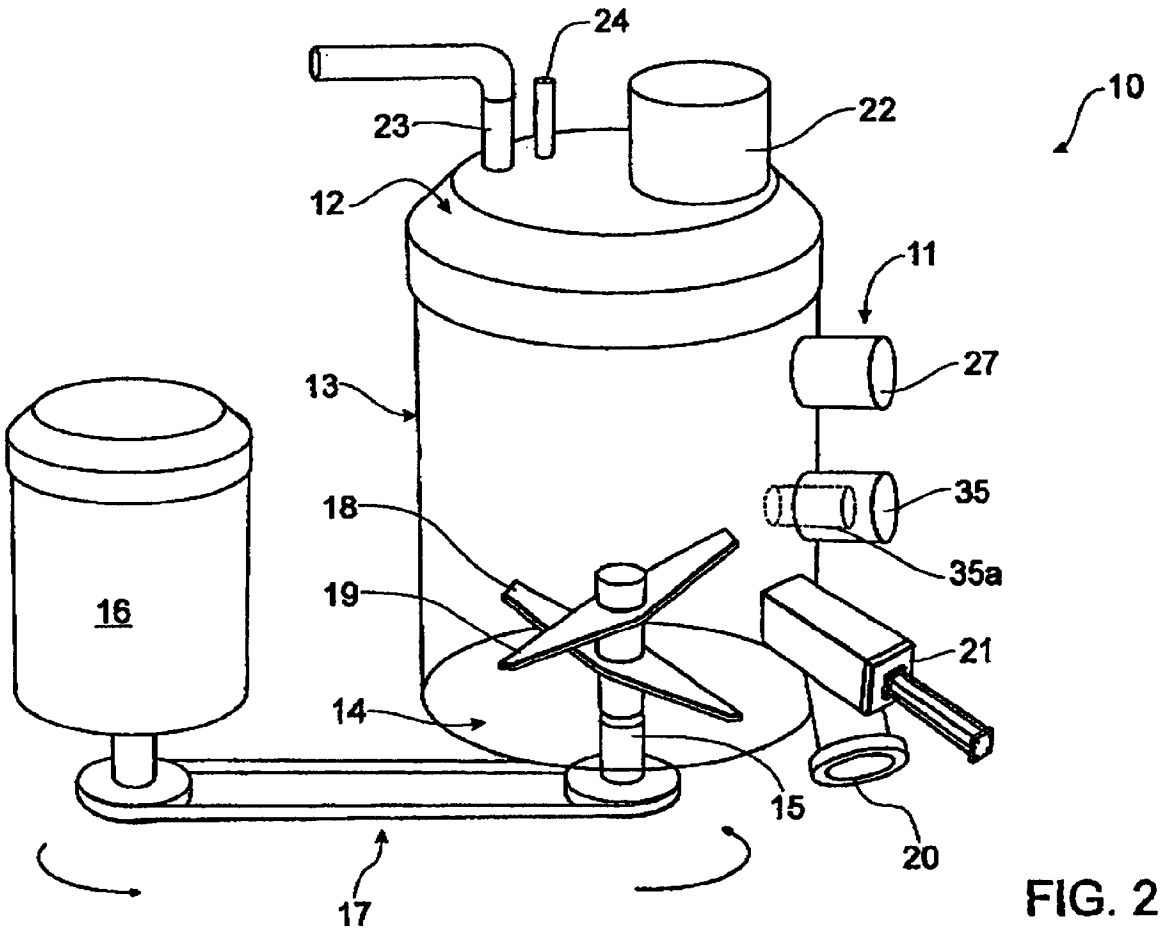
FIG. 2 is a schematic view of the mixing vessel of FIG. 1.

Referring to FIGS. 1 and 2, mixing vessel 10 has a cylindrical tank-like body 11 with a top wall (or lid) 12, side wall 13 and floor 14 formed of metal and/or plastics material. (The walls may be of metal skin/insulating core/metal skin construction.)

A shaft 16 is rotatably journalled in the bottom wall 14, substantially co-axial with the vertical axis of the vessel 10. The shaft 15 is driven via an electric motor 16 via a drive system 17 (eg., mechanical transmission/pulleys and belt/sprockets and chain).

Figure 3:
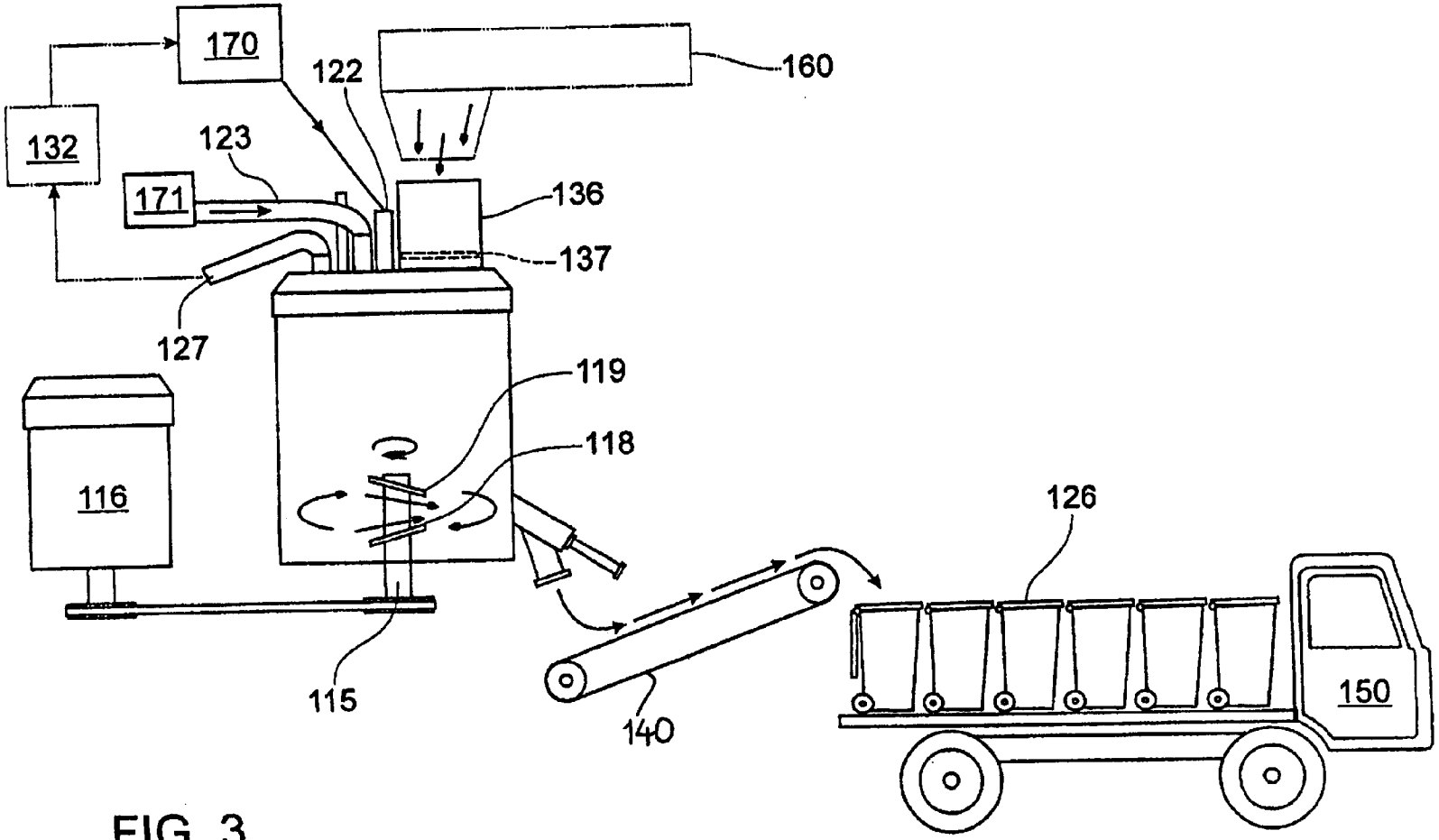
FIG. 3 is a schematic view of the machine for a second embodiment of the snow making method.

Respective first and second blades 18, 19 are mounted on the shaft 15 at spaced locations and extend substantially radially to the shaft 15. As shown in FIG. 3, the blades 18, 19 are inclined to the axis of the shaft 15 in opposite directions so that rotation of the shaft 15 will cause the lower blade 18 to "lift" the mixture in the vessel 10 and the upper blade 19 to "push down" the mixture in opposition thereto for complete mixing of the mixture.

A snow discharge outlet 20 is provided in the side wall 13, or floor 14, of the body 11 and is selectively closable by a valve controlled by an air cylinder 21.

The top wall or lid 12 has a cryogenic material inlet 22, a water inlet 23 and an additive inlet 24, where each may have a respective inlet valve (not shown).

Dry ice (CO2) pellets or snow are deposited into the mixing vessel 10, via the inlet 22, from a storage source or snow horn 25. Water is deposited into the mixing vessel 10, together with an additive (eg., sugar/salt/at a concentration of 0.25–1.0% (w/w)). The electric motor 16 is operated to drive the shaft 15 and the mixture in the mixing vessel 10 is agitated/mixed by the blades 18, 19 to cause the water to be converted into snow crystals, eg., within 10–15 seconds.

Preferably, the shaft 15 is rotated between 300 rpm and 5000 rpm, with 2000 rpm to 3000 rpm being a typical rotational speed. It is believed that the release of the $CO_2$ gas from the dry ice, together with the agitation/mixing of the mixture by the blades, operates to "aerate" or "foam" the mixture so that the water is converted into fine snow crystals of a nature identical, or similar, to natural snow. The snow produced by the present method has an appearance, texture and/or characteristic equal, or substantially identical, to natural snow.

The snow crystals are discharged into a suitable container 26, eg., a wheeled bin by operation of the air cylinder 21 to open the snow discharge outlet 20.

The operation is then repeated for the next batch.

The $CO_2$ gas released from the dry ice can be recovered for recycling into liquid or solid $CO_2$, to minimise the operational costs.

The $CO_2$ gas is drawn from the vessel 10 via a gas outlet 27 by a non-lubricating compressor 28, which compresses the $CO_2$ to, eg., 1–2 Bar. The compressed $CO_2$ gas is passed through at least one drier 29 and condenser 30 to remove any water moisture. The dried gas is then passed through an evaporator 31 of a refrigeration unit 32, the evaporator being at a temperature of −5° C. to −70° C., preferably approximately −20° C.

The $CO_2$ gas will liquefy and collect at the bottom of the liquefier unit 33 and may be stored at a pressure of 1–3 Mpa, at −20° C. or lower, before return to the vessel 10 via $CO_2$ line 34 and liquid $CO_2$ inlet 35. The inlet 35 incorporates expansion valves and/or expansion chambers 35*a* to cause the liquid $CO_2$ to be released into the vessel 10 in the form of $CO_2$ snow or like solid particles, for mixing with the aqueous mixture in the vessel 10.

The $CO_2$ from the liquefier unit 33 may be stored in a tank (not shown) or be directed to the $CO_2$ source 25 when the mixer vessel 10 is not in operation.

In low temperature applications such as at a ski resort, the low ambient temperatures may be sufficient to condense the gaseous $CO_2$ avoiding the need for the refrigeration unit 32.

For safety, the mixing vessel 10 can be provided with a gas safety valve (not shown).

Figure 4:
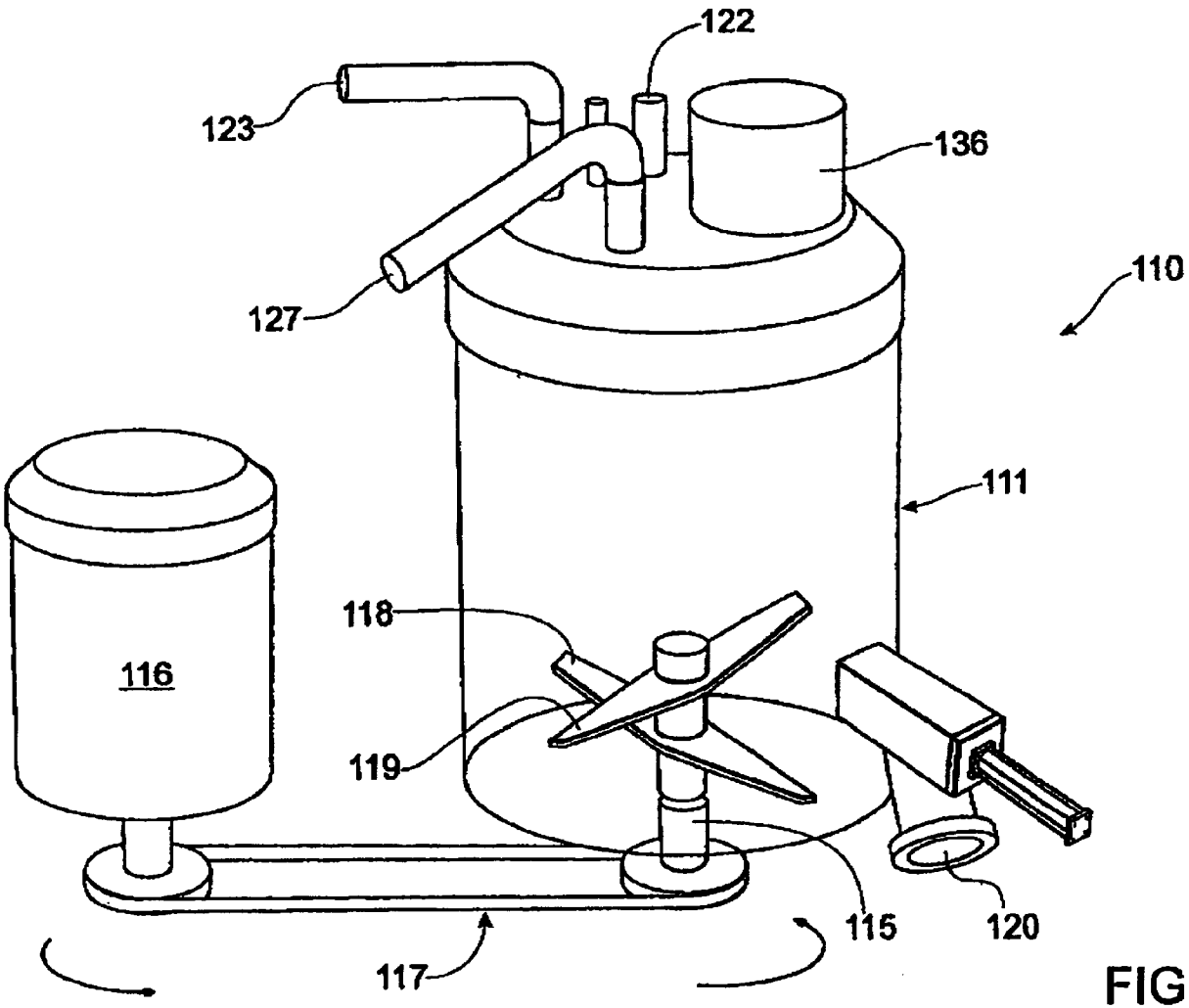
FIG. 4 is a schematic view of the mixing vessel of FIG. 3.

Referring now to FIGS. 3 and 4, the mixing vessel 110 of the second embodiment has a body 111, shaft 115, blades 118, 119 and drive 116, 117 substantially as hereinbefore described.

The snow can be discharged via the snow discharge outlet 120 onto a belt conveyor 140 into containers 126 on a vehicle 150 for transport to a remote site, eg., a sports stadium, sporting event or the like.

Ice, in block and/or lump form, is discharged from an ice making machine 160 through an ice inlet 138 provided with an inlet valve 137 and is mixed with $CO_2$ gas or liquid injected via $CO_2$ gas inlet 122 and water injected via water inlet 123, the $CO_2$ gas and water being supplied from respective sources 170, 171.

The water/ice/$CO_2$ mixture is agitated/mixed by the blades 118, 119 and the water/ice are converted to snow, for periodic, or batch, discharge via the snow discharge outlet 120.

The $CO_2$ gas liberated by the mixing may be drawn off via a $CO_2$ gas outlet 127 and may be refrigerated to a liquid state by a refrigeration unit 132 and returned to the $CO_2$ source 170 for re-use.

Figure 5:
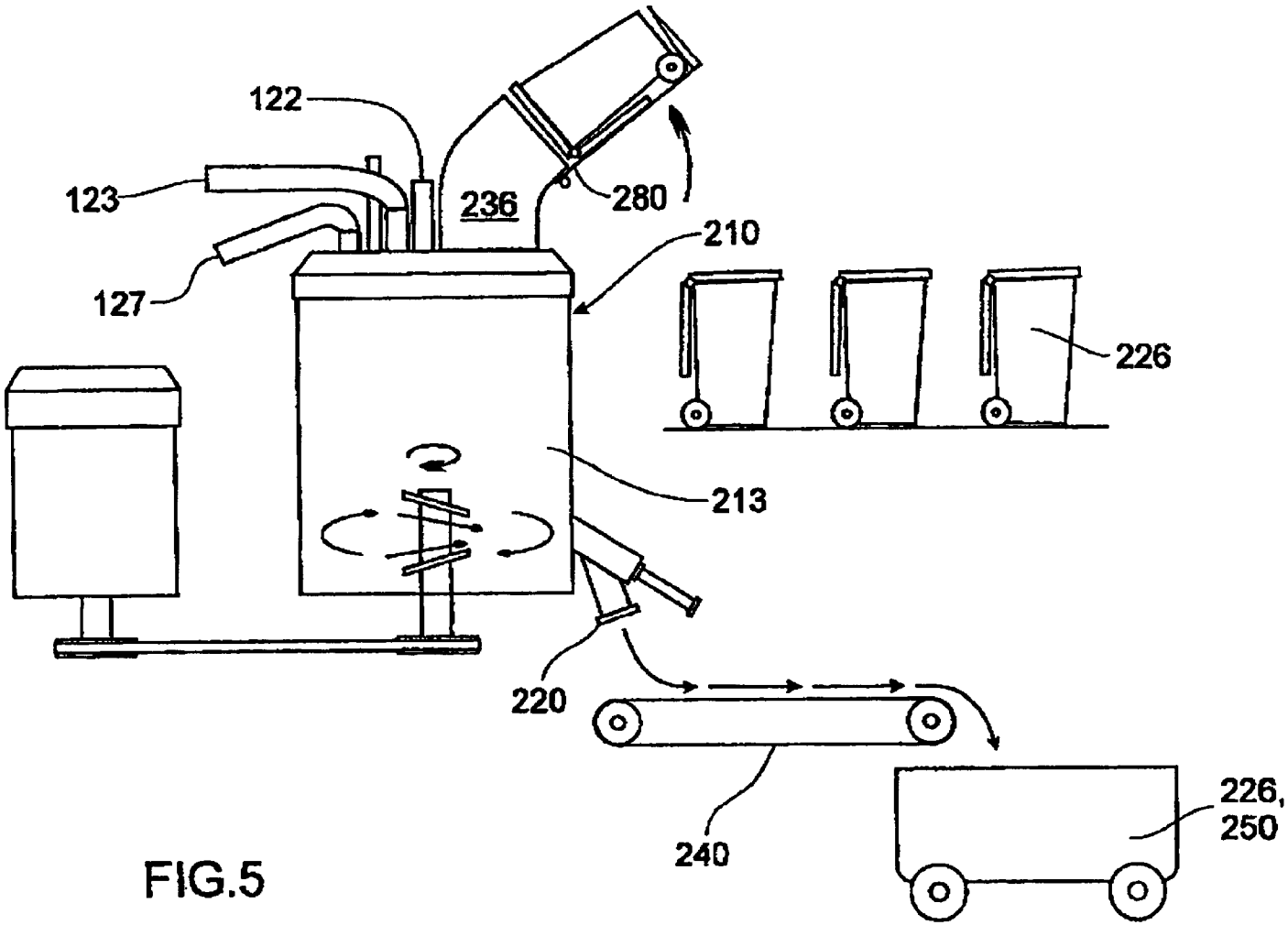
FIG. 5 is a schematic view of the machine for a third embodiment of the snow making method.

In the modified embodiment of FIG. 5, the ice may be supplied via containers 226 which are raised via a lift unit 280 to deposit the ice into the mixing vessel 210 via the ice inlet 236.

The method of making the snow is as hereinbefore described and the resultant snow may be discharged via the snow discharge outlet 220, onto a conveyor 240 and into a storage or transport container 226 or vehicle 250.

The snow discharge outlet 20, 120, 220 may be provided in the side wall 13, 113, 213, of the mixing vessel 10, 110, 210, for discharge of the centrifugal force due to the blades 18, 19, 118, 119 rotating at, eg., 500–3000 rpm; or be provided in the floor 14, 114 to enable gravity discharge from the mixing vessel 10, 110, 210.

Figure 6:
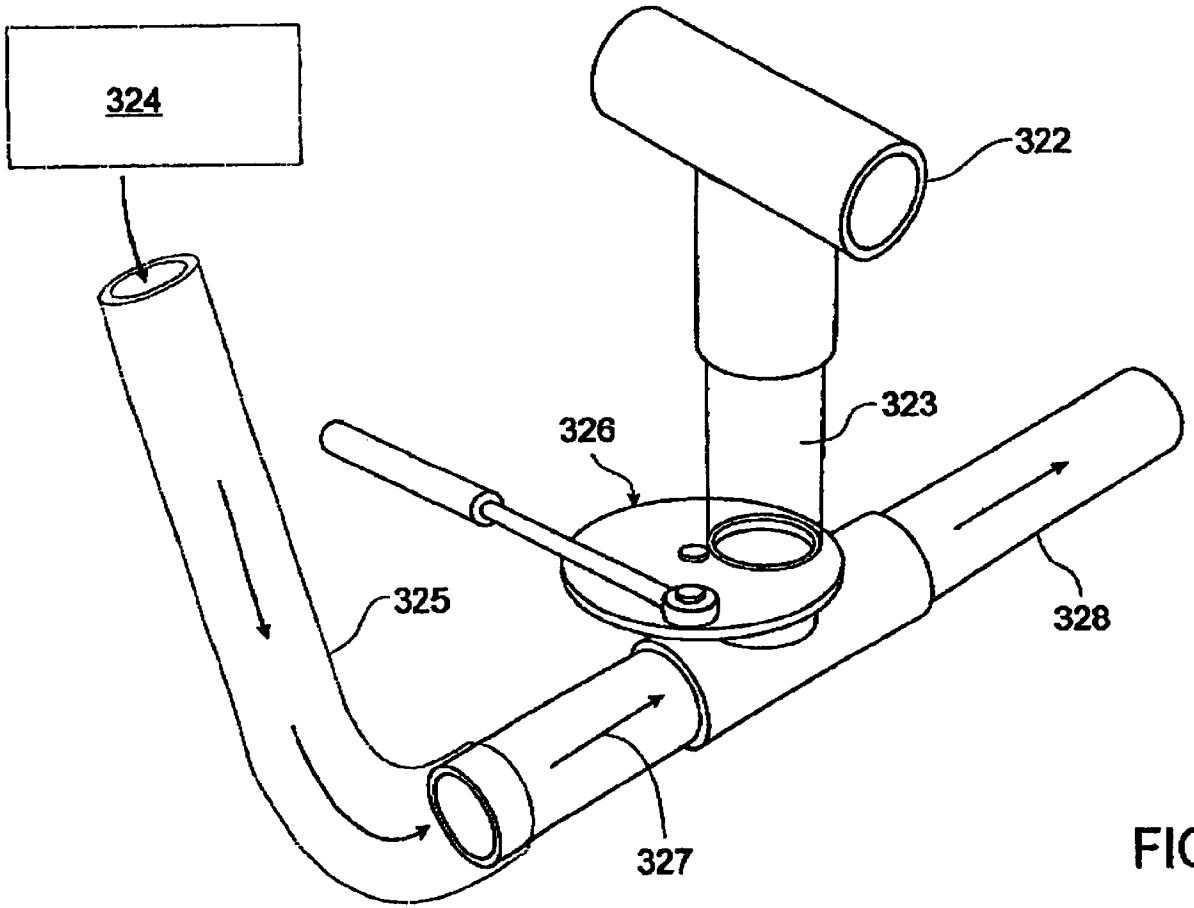
FIGS. 6 to 8 are schematic views of alternative apparatus for discharging the snow from the mixing vessels.

FIG. 6 illustrates an alternative snow discharge arrangement is 320 where the snow passes through a manifold 322, connected to the interior of the mixing vessel 10, 110, 210, and a pipe 323.

A blower 324 forces pressurised air through an air pipe 325 and snow released via a rotary valve 326 is entrained in air flow 327 through a blower pipe 328 for pneumatic transfer to a remote location.

Figure 7:
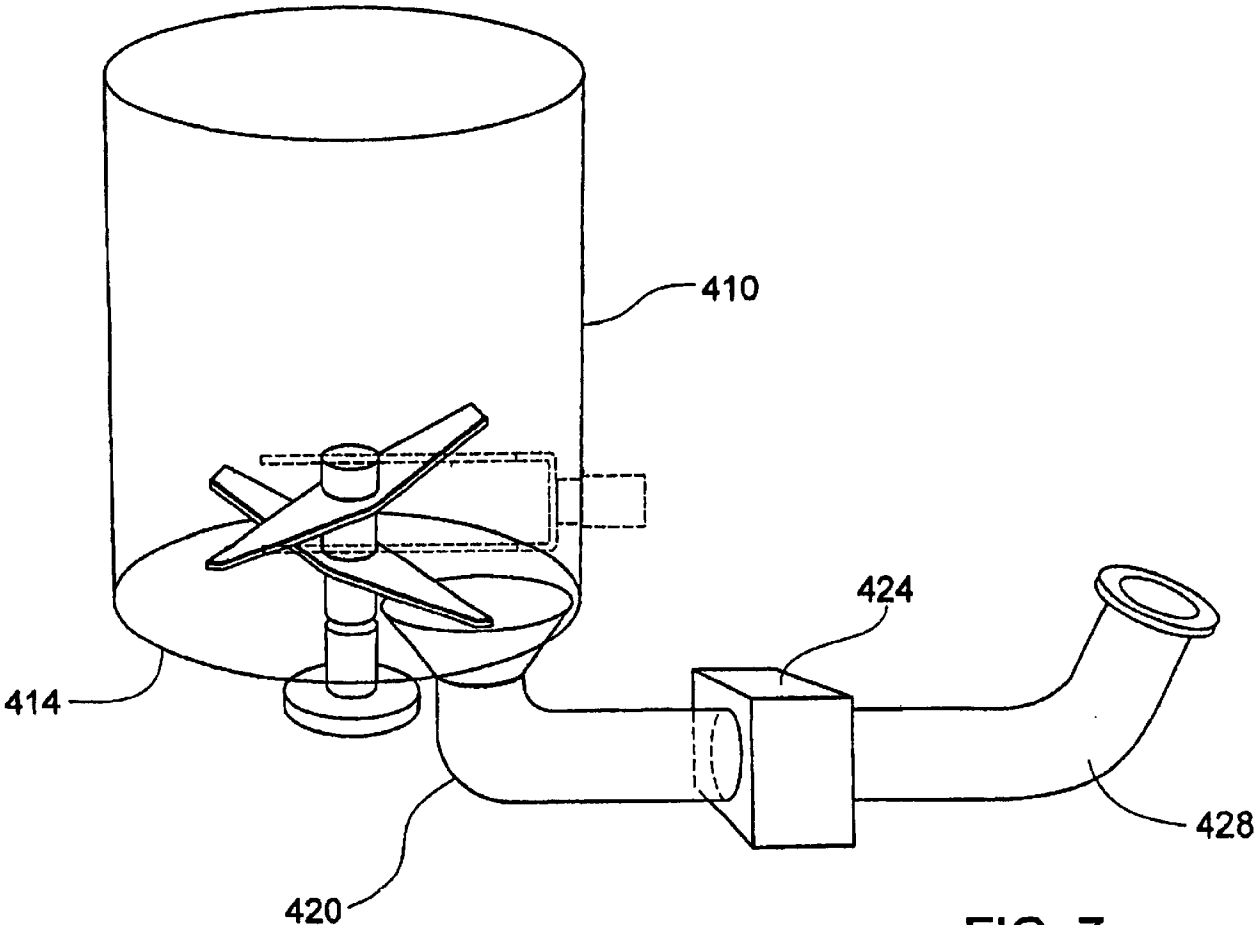

In the embodiment of FIG. 7, the snow from the mixing vessel 410 is discharged through a snow discharge outlet 420 in the floor 414. A suction/blower unit 424 draws the snow from the mixing vessel 410 and discharges it through a discharge pipe 428.

Figure 8:
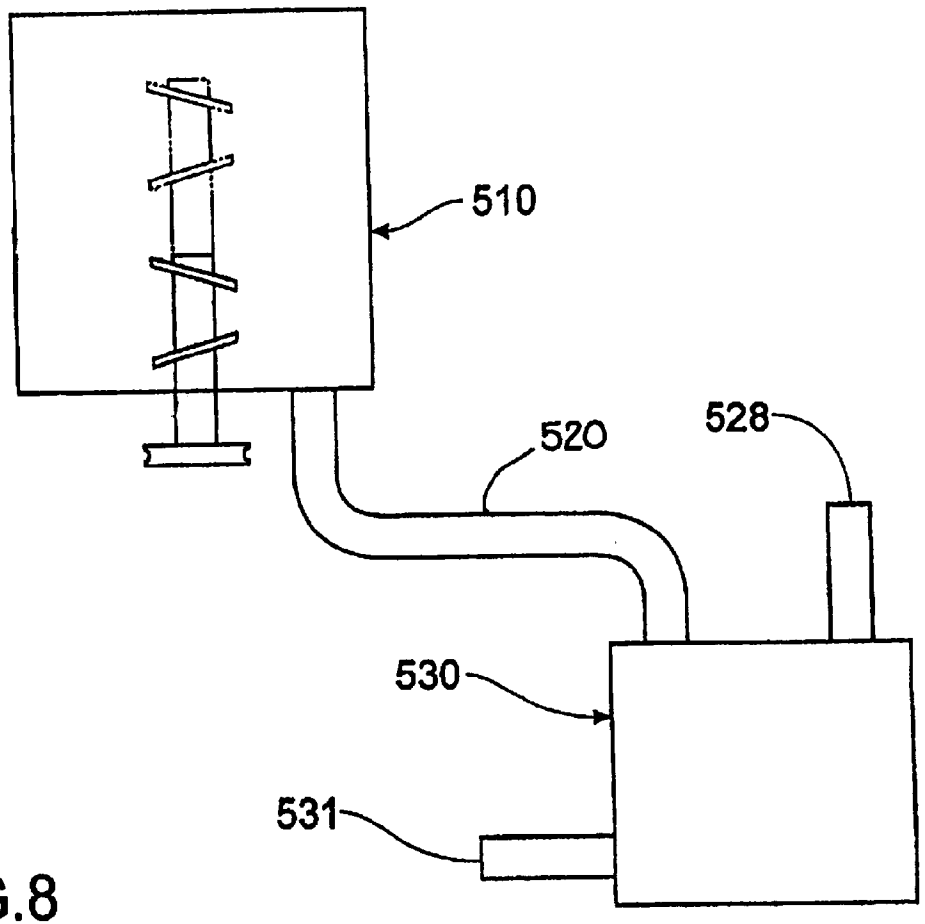

In the alternative embodiment of FIG. 8, the snow discharge outlet 520 is connected to a storage tank 530 which has a vacuum pump 531 so that a low pressure in the tank 530 draws the snow from the mixing vessel 510. The pump 531 may be reversed, or a pressure pump (not shown) forces the snow from the tank via a pipe 528.

In a further alternative embodiment (not shown), the top wall (or lid) 12, 113 may be hingedly connected to, or removable from, the mixing vessel 10, 110 and the latter may be tipped to discharge the snow from the vessel. This arrangement would preferably only be used for small volume, batch-type machines.

For ski slopes, the snow-making machine could be mounted on a vehicle, eg., a prime mover or trailer, and discharge the snow directly s to the skiing slope.

The snow produced can be of a quality for use in the food and/or beverage industries, eg., to cool food, such as seafood (such as seafood for display or transportation); mixed in drinks as an alternative to ice; or the like.

As up to 99% of the cryogenic material, eg., the dry ice, can be recovered (and re-used), the cost of production is minimised.

The machines can be scaled to suit the particular snow requirements of a particular installation or site; can be mobile; or can be installed in an ice works.

Advantages of the present invention include:

1. The machines can be created in a continuous or batch form of operational system, and machines can be built of all sizes from, eg., a large capacity to 10,000 liter batch capacity.

2. The machines can convert water and ice or a mixture of both into snow in less than 15 seconds per cycle.

3. The system can use as little as 5% of the liquid Nitrogen or Cryogenic material used in the known Polar Process, which amounts to an enormous saving in production costs for this form of snow making process.

4. The system can use any form of ice product or pure water alone to make snow and therefore can be used, in any location. The system mixes ice, water, or a mixture of both with a cryogenic material or refrigerant which can be recycled for re-use. The amount of cryogenic material, such as carbon dioxide or nitrogen, can be as little as 2 to 10% of the total mixture, and up to 99% of this material can be recovered for further use. The mixing of the materials is done in a specially designed insulated vessel that can create the powder snow product in amounts of up to one cubic meter or more in less than 10 seconds.

5. The system has major operational advantages that can benefit from ice making factories and consumers worldwide. This is because the system can be linked to any new or existing machine at an ice factory, which can be used to convert most ice products into high quality powder snow for the purposes of event or consumer use. In normal circumstances, an ice factory will sell its premium products for around $500 per tonne and their bulk ice products for as low as $70 per tonne. The production cost for the ice making for both products is normally around $20 per tonne or lower. For little extra operating cost the ice works operator can convert the cheaper bulk ice products into snow on an "as required" basis and, thereby, adding value to their cheaper product and improve the product range and profitability of his business.

6. The snow produced by this method and machine is a high quality powder snow, that is difficult to create with any form of artificial snow making machine. The snow produced by this cryogenic process can also be created to have a longer life cycle than an other snow produced, by varying the amount of cryogenic material included in the process. This also makes the storage of the product in cold rooms for later use more favourable as the snow does not stick together due to the elimination of all water from the process.

7. The snow system has a major cost advantage for indoor ski centre and ski resorts and areas that have below freezing ambient temperatures. In this regard, the ability to utilise the freezing conditions of the ambient air (which can be increased by the utilisation of high speed fans or the natural wind) to pre-chill the snow-making water to any for of ice or partial ice product in an indoor ski centre, this requires a minimal additional operating or capital cost and allows the opportunity to optimise the naturally occurring equipment or conditions to make snow for use at the ski area.

8. For events at any location, the ice making process can occur in a similar manner and minimal cost as for the use of the system at a ski resort location with below freezing temperature. This is done by providing a chilled air refrigeration truck or container that freezes water in the storage area into ice cubes or other particles which are used in the machine to make snow. At a ski resort with below freezing temperature, the ice can be made in the ambient atmosphere and distributed to the machine. The machine built for the process can be a batch type or continuous system and can incorporate a continuous ice feed for the production to occur.

9. The system is simple and operates quickly, and the snow produced can be used straight away or stored in a conventional freezer indefinitely for later use or consumer counter sales.

10. A recovery system can be built into the process to recycle the cryogenic material and further reduce the cost of snow production.

11. In low temperature applications, such as at a ski resort the low ambient temperatures that are prevalent can replace the need for a refrigeration system to condense the gaseous carbon dioxide.

Various changes and modifications may be made to the embodiments described and illustrated without departing from the present invention. For example, as illustrated in FIG. 7 the blades 418, 419 may be replaced by paddles/blades/scrapers 418*a* on a shaft 416*a*, driven by motor 416*a*, where the shaft is substantially horizontal and the snow is agitated about a horizontal axis.

What is claimed is:

1. A method of making snow including:

mixing water in the form of a free liquid and solid cryogenic material in a mixing vessel by mechanically agitating for mixing at a speed sufficient to convert the water into snow or snow-like crystals, wherein the water in the form of a free liquid is the major ingredient added to the mixing vessel.

2. The method as claimed in claim 1 wherein the mixing vessel operates at a speed in the range of 300 rpm to 5000 rpm.

3. The method as claimed in claim 2 wherein the missing vessel operates at a speed in the range of 2000 rpm to 3000 rpm.

4. The method as claimed in any one of claims 1, 2, or 3 wherein the mixing vessel includes two counter-rotatable blades or knives.

5. The method as claimed in claim 1 wherein:

the solid cryogenic material is dry ice ($CO_2$).

6. The method as claimed in claim 1 further including;

adding an additive, selected from the group consisting of salt, sugar and other soluble material in the range of 0.25% to 1.0% (w/w).

7. The method as claimed in claim 1 wherein:

the $CO_2$ gas released during mixing is drawn off the mixing vessel and refrigerated to form liquid $CO_2$ or solid $CO_2$ for subsequent reintroduction to the mixing vessel.

8. A method of making snow including:

mixing ice and a cryogenic material in a mixing vessel by mechanically agitating or mechanically mixing at a speed in the range of 500 to 3000 rpm to convert the ice into snow or snow-like crystals, wherein the ice is the major ingredient added to the mixing vessel.

9. The method as claimed in claim 8 wherein the mixing vessel includes counter-rotating blades or knives.

10. The method as claimed in claim 5, wherein:

the cryogenic material constitutes 2% to 10% (w/w) of the mixture.

11. The method as claimed in claim 10 wherein the cryogenic material constitutes 5% to 7% (w/w) of the mixture.

12. The method as claimed in claim 8 wherein:

the cryogenic material is carbon dioxide ($CO_2$), nitrogen ($N_2$), oxygen ($O_2$), frozen brine solution or other suitable cryogenic material in solid, liquid and/or gaseous form.

13. A method as claimed in claim 12 wherein:

the cryogenic material is placed in the mixing vessel, before the introduction of the ice, to assist in cooling the walls of the vessel.

14. A method as claimed in claim 8 wherein:

the resultant snow is tipped from the vessel by gravity via a valve; is drawn from the vessel by vacuum or suction means; or is discharged through an outlet in a side wall of the vessel by centrifugal force; or by other suitable discharge means.

15. A method of making snow including:

mixing water in the form of a free liquid and/or ice and a cryogenic material in a mixing vessel having a mechanical agitator or a mechanical mixer by mechanically agitating or mixing at a speed sufficient to convert the water and/or ice into snow or snow-like crystals, wherein the ice and/or water in the form of a free liquid is the major ingredient added to the mixing vessel.

16. The method as claimed in claim 15 involving the mixing of ice and cryogenic material wherein the mixing vessel operates at a speed in the range of 500 to 3000 rpm.

17. The method as claimed in claim 15 wherein the mixing vessel includes counter-rotating blades or knives.

18. The method as claimed in claim 15 wherein:

the cryogenic material constitutes 2% to 10% (w/w) of the mixture.

19. The method as claimed in claim 18 wherein the cryogenic material constitutes 5% to 7% (w/w) of the mixture.

20. The method as claimed is claim 19 wherein:

the cryogenic material is carbon dioxide ($CO_2$), nitrogen ($N_2$), oxygen ($O_2$), frozen brine solution or other suitable cryogenic material in solid, liquid and/or gaseous form.

21. A method as claimed in claim 15 wherein:

the cryogenic material is placed in the mixing vessel, before the introduction of the water and/or ice, to assist in cooling the walls of the vessel.

22. A method as claimed in claim 15 wherein:

the resultant snow is tipped from the vessel by gravity via a valve; is drawn from the vessel by vacuum or suction means; or is discharged through an outlet in a side wall of the vessel by centrifugal force; or by other suitable discharge means.

* * * * *

UNITED STATES PATENT AND TRADEMARK OFFICE

CERTIFICATE OF CORRECTION

PATENT NO. : 6,938,830 B2
APPLICATION NO. : 10/475228
DATED : September 6, 2005
INVENTOR(S) : Alfio Bucceri It is certified that error appears in the above-identified patent and that said Letters Patent is hereby corrected as shown below:

Please change at Col. 6, line 39:

-- "for" to --or--

Please change at Col. 6, line 46:

-- "missing" to --mixing--

Signed and Sealed this

Ninth Day of January, 2007

JON W. DUDAS
*Director of the United States Patent and Trademark Office*